United States Patent [19]

Laver

[11] Patent Number: 4,926,190

[45] Date of Patent: May 15, 1990

[54] INK JET RECORDING PROCESS USING CERTAIN BENZOTRIAZOLE DERIVATIVES AS LIGHT STABILIZERS

[75] Inventor: Hugh Laver, Fribourg, Switzerland

[73] Assignee: Ciba-Geigy Corporation, Ardsley, N.Y.

[21] Appl. No.: 153,695

[22] Filed: Feb. 8, 1988

[30] Foreign Application Priority Data

Feb. 18, 1987 [CH] Switzerland ..... 599/87

[51] Int. Cl.[5] ..... B41M 5/00

[52] U.S. Cl. ..... 346/1.1; 346/135.1; 427/256; 427/261; 427/285; 428/195; 428/211; 428/690; 428/913

[58] Field of Search ..... 428/195, 211, 913, 537.5, 428/690; 346/1.1, 135.1; 427/256, 261, 288

[56] References Cited

U.S. PATENT DOCUMENTS

| | | | |
|---|---|---|---|
| 4,256,493 | 3/1981 | Yokoyama et al. | 106/22 |
| 4,547,405 | 10/1985 | Bedell et al. | 427/256 |
| 4,853,471 | 8/1989 | Rody et al. | 524/91 |

FOREIGN PATENT DOCUMENTS

| | | | |
|---|---|---|---|
| 0057160 | 8/1982 | European Pat. Off. | 430/269 |
| 2088777A | 6/1982 | United Kingdom | 346/1.1 |

OTHER PUBLICATIONS

Research Disclosure, 24239; Jun. 1984.
Research Disclosure, 22519; Jan. 1983.

*Primary Examiner*—Pamela R. Schwartz
*Attorney, Agent, or Firm*—Luther A. R. Hall

[57] ABSTRACT

UV-absorbers of the formula I

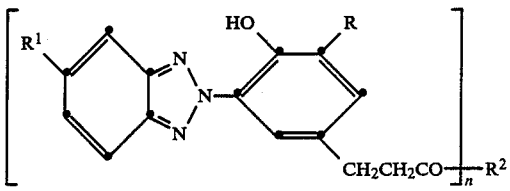

(I)

in which n is 1 to 4, R is H, $C_1$–$C_{12}$alkyl, $C_5$–$C_8$cycloalkyl, phenyl or $C_7$–$C_9$phenylalkyl, $R^1$ is H, Cl, $C_1$–$C_4$alkyl or $C_1$–$C_4$alkoxy and $R^2$ is an n-valent hydrophilic group, are especially suitable for the light stabilization of ink-jet prints. The compound of the formula I is here added to the recording material, preferably in a surface coating. Such compounds have the further advantage that they form particularly stable emulsions.

7 Claims, No Drawings

INK JET RECORDING PROCESS USING CERTAIN BENZOTRIAZOLE DERIVATIVES AS LIGHT STABILIZERS

The invention relates to the use of certain UV absorbers of the type of 2-(2-hydroxyphenyl)-benzotriazoles as light stabilizers for recording materials for ink-jet printing, and to the recording materials stabilized against light-induced damage by means of these compounds.

Printing by means of an ink jet is a very rapid printing process, which can be controlled by electrical signals. In this case, a fine jet of ink droplets is sprayed through a nozzle onto the recording material. The ink is a solution of a dye in an aqueous or non-aqueous solvent. The recording material should rapidly and durably absorb the dye from the ink. In most cases, specially prepared papers or plastic sheets are used for this purpose, which are coated with a dye-binding layer. Because of the fineness of the nozzles, pigments are hardly used, but predominantly dyes which are fully dissolved in the ink jet medium. However, these dyes generally have a lower light fastness than the colour pigments usual in conventional printing inks. Consequently, recordings made by ink-jet printing have only a limited storage life in the presence of light. In the case of prolonged storage in light, they start to fade or to discolour.

In order to solve this problem, it has already been proposed (U.S. Pat. No. 4,256,493) to add a water-soluble UV absorber to the ink. By interaction with the dye, solid particles can then precipitate in the ink, which block the fine nozzle. A different approach has therefore been taken, by adding light stabilizers to the recording material. Thus, in GB-A No. 2,088,777, an addition of UV absorbers of the benzotriazole type in combination with sterically hindered phenols is proposed as a measure against bleaching of the dyes. These additives are admixed in the dissolved form to a coating composition of colourless fillers, a binder and a dye receptor or mordant, this composition being applied to one side of the recording material (paper in most cases). The light stabilization of hard-copy prints, including ink-jet prints, by the addition of UV absorbers of various types to the recording material has been described in Research Disclosure No. 24,239 (1984, 284).

It has now been found that certain UV absorbers of the benzotriazole type are particularly suitable for this purpose. These are compounds of the formula I

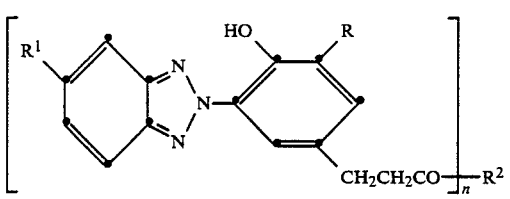

(I)

in which n is 1 to 4, R is hydrogen, $C_1$–$C_{12}$alkyl, $C_5$–$C_8$-cycloalkyl, phenyl or $C_7$–$C_9$phenylalkyl, $R^1$ is hydrogen, chlorine, $C_1$–$C_4$alkyl or $C_1$–$C_4$alkoxy and, in the case of n=1, is also —$COOR^3$, $R^2$ (a) in the case of n=1, is an —$OR^3$ or $NR^4R^5$ group, (b) in the case of n=2, is a divalent —O—$R^6$—O—, —O—$R^6$—N($R^7$)—, —N($R^7$)—$R^8$—N($R^7$)— group or

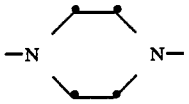

(c) in the case of n=3, is a trivalent

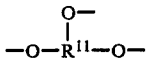

or —N($R^7$)—

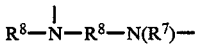

group and (d) in the case of n=4, is a tetravalent

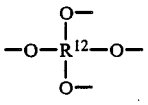

or —N($R^7$)—

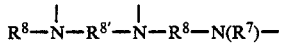

group, in which $R^3$ is hydrogen, $C_1$–$C_{18}$alkyl, which is monosubstituted or polysubstituted by —OH or —O—$COR^{10}$, $C_3$–$C_{30}$alkyl which is interrupted by one or more —O— or —N($R^7$)— and can be monosubstituted or polysubstituted by —OH or —O—COR10 groups, unsubstituted or OH-substituted $C_5$–$C_{12}$cycloalkyl, unsubstituted or OH-substituted $C_2$–$C_{18}$alkenyl, $C_7$–$C_{15}$-phenylalkyl or $C_7$–$C_{15}$alkylphenylalkyl, glycidyl, furfuryl or a glycosyl group, $R^4$ and $R^5$ independently of one another are hydrogen, $C_1$–$C_{18}$alkyl, $C_1$–$C_4$hydroxyalkyl, $C_3$–$C_{30}$alkyl which is interrupted by —O— or —N($R^7$)—, $C_5$–$C_{12}$cycloalkyl, phenyl which is unsubstituted or substituted by hydroxyl, $C_1$–$C_4$-alkoxy or halogen, $C_3$–$C_8$ alkenyl, $C_7$–$C_{15}$phenylalkyl or $C_7$–$C_{15}$alkylphenylalkyl, or $R^4$ and $R^5$, together with the N atom, form a pyrrolidine, piperidine, piperazine or morpholine ring, $R^6$ is $C_2$–$C_8$alkenylene, $C_4$–$C_8$alkenylene, $C_4$ alkynylene, cyclohexylene, $C_4$–$C_{30}$alkylene which is interrupted by one or more —O— or —N($R^7$)—, or a group —$CH_2$—CH(OH)—$CH_2$—O—$R^9$—O—$CH_2$—CH(OH)—$CH_2$— or

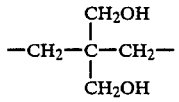

$R^7$ is hydrogen or $C_1$–$C_{18}$alkyl, $R^8$ is $C_2$–$C_{12}$alkylene which can be interrupted by one or more —O—, $R^9$ is $C_2$–$C_8$alkylene, $C_4$–$C_{10}$alkylene which is interrupted by one or more —O—, cyclohexylene, phenylene or a group

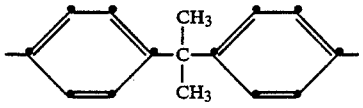

$R^{10}$ is $C_1$–$C_{18}$alkyl or phenyl, $R^{11}$ is $C_3$–$C_{10}$alkanetriyl and $R^{12}$ is $C_4$–$C_{12}$alkanetetrayl.

Some of the compounds of the formula I have been described in EP-A No. 57,160 as stabilizers for organic materials, for example polymers, surface coatings or photographic materials. The preparation of these compounds is also described therein. Inasmuch as the compounds are novel, they can be prepared analogously thereto. In Research Disclosure No. 22,519 (1983 [1], 6), the use of such benzotriazoles as light stabilizers for reproduction materials and for the dyes contained therein is proposed. The use in inks is also mentioned there. A use in recording materials for ink-jet printing is not mentioned therein.

$C_1$–$C_{12}$Alkyl R can, for example, be methyl, ethyl, isopropyl, n-butyl, tert-butyl, sec-butyl, tert-pentyl, sec-pentyl, n-hexyl, sec-hexyl, n-octyl, ditert-octyl, sec-decyl or n-dodecyl. Cycloalkyl R can especially be cyclohexyl. Phenylalkyl R can especially be $\alpha,\alpha$-dimethyl-benzyl. Preferably, R is a branched alkyl radical, especially tert-butyl.

$C_1$–$C_4$Alkyl or $C_1$–$C_4$alkoxy $R^1$ can, for example, be methyl, ethyl, propyl, isopropyl, butyl, tert-butyl, methoxy, ethoxy, isopropoxy, butoxy or tert-butoxy.

$C_1$–$C_{18}$Alkyl $R^4$, $R^5$, $R^7$ and $R^{10}$ can be unbranched or branched alkyl, for example methyl, ethyl, propyl, isopropyl, n-butyl, sec-butyl, isobutyl, tert-butyl, n-pentyl, isopentyl, n-hexyl, 2-ethylbutyl, n-octyl, isooctyl, 2-ethylhexyl, 1,1,3,3-tetraethylbutyl, n-decyl, isodecyl, n-dodecyl, 1,1,7,7-tetramethyloctyl, n-tetradecyl or n-octadecyl.

Alkyl $R^3$ which is substituted by —OH or —O-$COR^{10}$ can, for example, be 2-hydroxyethyl, 2-hydroxypropyl, 2-hydroxylbutyl, 3-hydroxybutyl, 2,3-dihydroxypropyl, 2,2-di-(hydroxymethyl)-propyl, 4-hydroxybutyl, 6-hydroxyhexyl, 8-hydroxyoctyl, 2-acetoxyethyl, 2-propionyloxyethyl, 2-octanoyloxypropyl, 2,3-diacetyloxypropyl or 4-acetoxybutyl.

$C_3$–$C_{30}$Alkyl $R^3$, $R^4$ and $R^5$ which is interrupted by —O— or —N($R^7$)— can, for example, be 2-methoxyethyl, 2-ethoxyethyl, 2-butoxyethyl, 2-isopropoxyethyl, 2-octyloxyethyl, 3,6-dioxaheptyl, 3,6,9-trioxaundecyl, 3,6,9,12-tetraoxatridecyl, 5-hydroxy-3-oxapentyl or 11-hydroxy-3,6,9-trioxaundecyl. In particular, $R^3$ is a radical —$CH_2CH_2O_mCH_3$ with m=2–10.

$C_1$–$C_4$Hydroxyalkyl $R^4$ and $R^5$ can, for example, be hydroxymethyl, 2-hydroxyethyl, 2-hydroxypropyl, 3-hydroxypropyl or 2-hydroxybutyl.

$C_5$–$C_{12}$Cycloalkyl $R^4$ and $R^5$ can, for example, be cyclopentyl, cyclohexyl, methylcyclohexyl, cyclooctyl or cyclododecyl.

$R^3$ can also be OH-substituted cycloalkyl, for example 4-hydroxycyclohexyl.

$C_2$–$C_{18}$Alkenyl $R^3$ which can be substituted by OH can, for example, be vinyl, allyl, methallyl, 2-buten-1-yl, oleyl or 4-hydroxy-2-buten-1-yl. $C_3$–$C_8$Alkenyl $R^4$ and $R^5$ can especially be allyl.

$C_7$–$C_{15}$Phenylalkyl or $C_7$–$C_{15}$alkylphenylalkyl $R^3$, $R^4$ and $R^5$ can, for example, be benzyl, 2-phenylethyl, 1-phenylethyl, 3-phenylpropyl, 2-phenylprop-2-yl, 4-methylbenzyl or 4-octylbenzyl.

Phenyl $R^4$ and $R^5$ which is substituted by alkyl, alkoxy or halogen can, for example, be 4-tolyl, 4-isopropylphenyl, 3-methoxyphenyl, 4-ethoxyphenyl, 4-fluorophenyl or 4-chlorophenyl.

$C_2$–$C_8$Alkylene $R^6$ and $R^9$ can be branched or straight-chain alkylene, for example 1,2-ethylene, tri-, tetra-, penta-, hexa- or octamethylene, 2,2-dimethyl-1,3-propylene, 1,2-propylene or 1,2-butylene. In addition, $C_2$–$C_{12}$alkylene $R^8$ can also, for example, be decamethylene or dodecamethylene.

Alkenylene or alkynylene $R^6$ can, for example, be 1,4-but-2-enylene, 1,4-but-2-inylene or 2-methyl-1,4-but-2-enylene.

Alkylene $R^6$ and $R^9$ which is interrupted by —O— or —N($R^7$)— can, for example, be 3-oxa-1,5-pentylene, 3,6-dioxa-1,8-octylene, 3,6,9-trioxa-1,11-undecylene, 3-methylaza-1,5-pentylene or 3,9-dioxa-5-methylaza-1,11-undecylene. $R^6$ is especially a radical —$CH_2CH_2O_mCH_2CH_2$— with m=1–6.

An alkanetriyl radical $R^{11}$ can, for example, be propane-1,2,3-triyl or a $CH_3C(CH_2—)_3$ or $C_2H_5C(CH_2—)_3$ radical.

An alkanetetrayl radical $R^{12}$ can, for example, be butane-1,2,3,4-tetrayl or a $C(CH_2—)_4$ radical.

Those compounds of the formula I are preferably used in which n is 1 or 2, R is $C_1$–$C_4$alkyl, $R^1$ is hydrogen, chlorine or methoxy, $R^2$ is (a) an —$OR^3$ or —$NR^4R^5$ group in the case of n=1 or (b) an —O—$R^6$—O— group in the case of n=2, $R^3$ being hydrogen, $C_1$–$C_{18}$alkyl which is substituted by 1 to 3 OH groups, $C_3$–$C_{18}$alkyl which is interrupted by one or more —O— and can be substituted by one or more —OH, cyclohexyl or allyl, $R^4$ and $R^5$ independently of one another are $C_1$–$C_{12}$alkyl, $C_2$–$C_4$hydroxyalkyl or $C_3$–$C_{12}$alkoxyalkyl or $R^4$ and $R^5$, together with the N atom, form a pyrrolidine, piperidine, piperazine or morpholine ring, $R^6$ is $C_2$–$C_6$alkylene, $C_4$–$C_{14}$-alkylene which is interrupted by one or more —O— or a —$CH_2$—CH(OH)—$CH_2$—O—$R^9$—O—$CH_2$—CH(OH)—$CH_2$— group and $R^9$ is $C_2$–$C_4$-alkylene or $C_4$–$C_8$alkylene which is interrupted by one or more —O—.

Amongst these, those compounds of the formula I are preferred in which R is tert-butyl.

Depending on the definition of $R^2$, the compounds of the formula I are carboxylic acids, carboxylic acid esters or carboxylic acid amides. The esters are particularly suitable, especially the compounds of the formula I in which n is 1 or 2 and $R^2$ is an —$OR^3$ or —O—$R^6$—O— group.

With particular preference, those compounds of the formula I are used in which n is 1 or 2, $R^1$ is hydrogen, chlorine or methoxy, $R^2$ is (a) a group of the formula $$-O\left(CH_2CH_2O\right)_u H,\quad -O\left(CH_2-\underset{\displaystyle CH_3}{\underset{|}{CH}}-O\right)_v H \text{ or}$$

$$-O\left(CH_2-\underset{\displaystyle OH}{\underset{|}{CH}}-CH_2-O\right)_w H,$$

in which u is 1–9, v is 1–6 and w is 1–6, in the case of n=1 and (b) a group of the formula $$-O\left(CH_2CH_2O\right)_x \text{ or } -O\left(CH_2-\underset{\displaystyle CH_3}{\underset{|}{CH}}-O\right)_y,$$

in which x is 1–7 and y is 1–4, in the case of n=2.

Those compounds of the formula I are also preferred in which n is 1, $R^1$ is —$COOR^3$ and $R^2$ is —$OR^3$.

Preferably, those compounds of the formula I are used which are liquid at room temperature.

Examples of individual compounds of the formula I are the compounds of the following formulae:

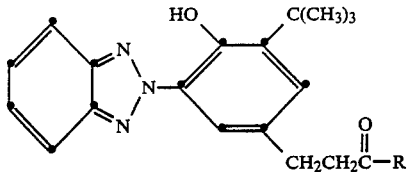

(a)

R = $-OCH_2CH_2OCH_2CH_2OC_2H_5$ (1)

R = $-OCH_2CH_2OCH_2CH_2OC_4H_9$-n (2)

R = $-OCH_2CH_2OH$ (3)

R = $-O\text{-}(CH_2CH_2O)_2H$ (4)

R = $-O\text{-}(CH_2CH_2O)_3H$ (5)

R = $-O\text{-}(CH_2CH_2O)_3CH_3$ (6)

R = $-O\text{-}(CH_2CH_2O)_{4.7}H$ (7)

R = $-O\text{-}(CH_2CH_2O)_mH$ m = 5–7 (8)

R = $-O\text{-}(CH_2CH_2O)_mCH_3$ m = 5–7 (9)

(10)

R = 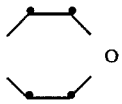

R = $-NHCH_2CH_2OCH_2CH_2OCH_2CH_2OC_4H_9$-n (11)

R = $-NHC(CH_2OH)_3$ (12)

R = $-OCH_2CH(OH)CH_2OH$ (13)

R = $-OCH_2CH(OH)CH_2OC_4H_9$-n (14)

R = $-OCH_2CH(OH)CH_3$ (15)

R = $-NHCH_2CH_2OC_2H_5$ (16)

R = $-OCH_2CH(OH)CH_2OCH_2CH(C_2H_5)-C_4H_9$-n (17)

R = $-O-CH_2CH(OH)CH_2OC_6H_{13}$-n (18)

R = $-O\text{-}(CH_2-CH(CH_3)-O)_2H$ (19)

R = $-O\text{-}(CH_2-CH(CH_3)-O)_mH$ m = 3–6 (20)

R = $-O\text{-}(CH_2-CH(CH_3)-O)_mCH_3$ m = 3–6 (21)

R = $-O\text{-}(CH_2-CH(OH)-CH_2-O)_2H$ (22)

R = $-O\text{-}(CH_2-CH(OH)-CH_2-O)_mH$ m = 3–5 (23)

(b)

R = 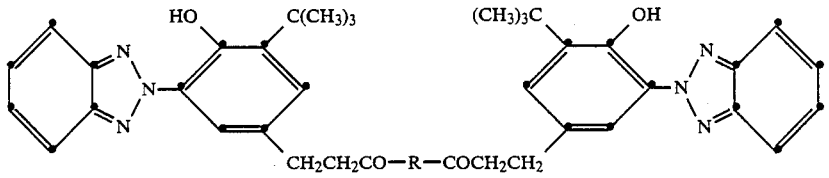

R = $-OCH_2CH_2O-$ (24)

-continued $R = -O(CH_2CH_2O)_2$ (25)

$R = -O(CH_2CH_2O)_3$ (26)

$R = -O(CH_2CH_2O)_4$ (27)

$R = -O(CH_2CH_2O)_m$ m = 5–7 (28)

$R = -O[CH_2CH(CH_3)-O]_2$ (29)

$R = -O[CH_2CH(CH_3)-O]_3$ (30)

$R = -O-CH_2CH(OH)CH_2-O-(CH_2)_8-O-CH_2CH(OH)CH_2-O-$ (31)

(c)

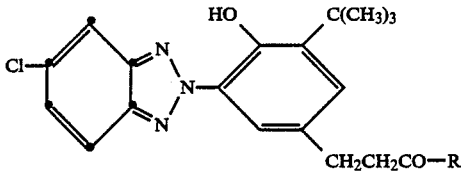

$R = -OCH_2CH_2OH$ (32)

$R = -O(CH_2CH_2O)_3H$ (33)

$R = -O-CH_2CH_2O)_mH$ m = 5–7 (34)

$R = -NH-C(CH_2OH)_3$ (35)

(36)

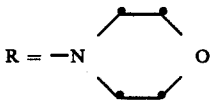

$R = -NH-(CH_2)_3-OCH_2CH_2OCH_2CH_2-OC_4H_9\text{-n}$ (37)

$R = -NH-(CH_2)_3-OC_8H_{17}$ (38)

$R = -OCH_2CH(OH)CH_2-OC_8H_{17}$ (39)

$R = -OCH_2CH_2OCH_2CH_2-OC_4H_9\text{-}9$ (40)

$R = -OCH_2CH_2OCH_2CH_2-OC_2H_5$ (41)

$R = -OCH_2CH(OH)CH_2-OCH_2CH{=}CH_2$ (42)

$R = -OCH_2CH(OH)CH_2-OC_4H_9\text{-n}$ (43)

(44)

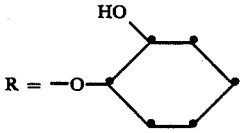

(d)

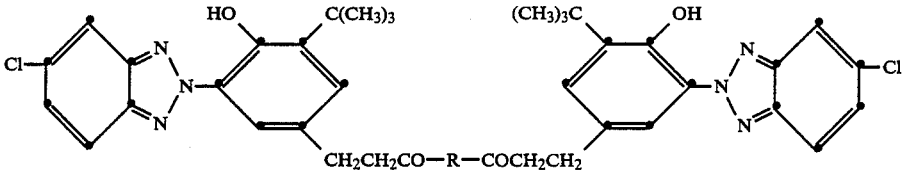

$R = -OCH_2CH_2OCH_2CH_2O-$ (45)

$R = -O(CH_2CH_2O)_3$ (46)

$R = -O(CH_2CH_2O)_m$ m = 5–7 (47)

$R = -OCH_2CH(OH)CH_2-O-(CH_2)_4-O-CH_2CH(OH)CH_2O-$ (48)

-continued

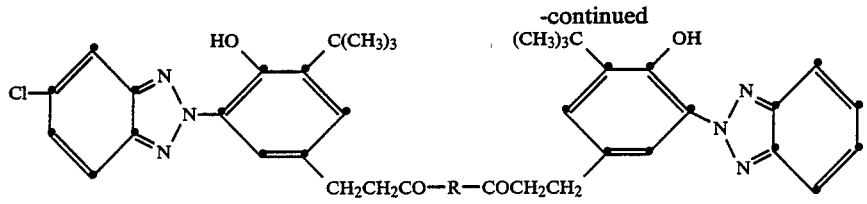

(e)

R = —O—$CH_2CH_2$—O— (49)

R = —O(—$CH_2CH_2O$)$_3$— (50)

R = —O(—$CH_2CH_2O$)$_m$— m m = 5–7 (51)

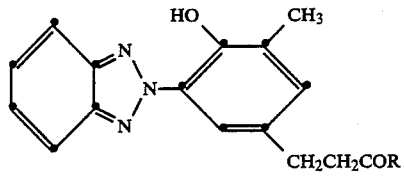

(f)

R = —$OCH_2CH_2OCH_2CH_2OCH_3$ (52)

R = —O(—$CH_2CH_2O$)$_2$—H (53)

R = —O(—$CH_2CH_2O$)$_4$—$C_2H_5$ (54)

R = —$OCH_2CH(OH)CH_2OH$ (55)

R = —O(—$CH_2CH_2O$)$_m$—H m = 8–10 (56)

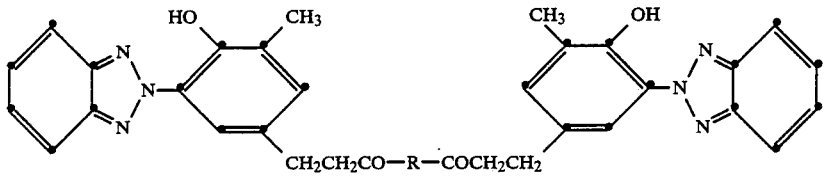

(g)

R = —O(—$CH_2CH_2O$)$_2$— (57)

R = —O(—$CH_2CH_2O$)$_4$— (58)

R = —O(—$CH_2CH_2O$)$_m$— m= 8–10 (59)

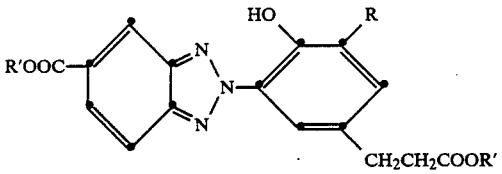

(h)

R = tert.$C_4H_9$ R' = —O(—$CH_2CH_2O$)$_2$—$CH_3$ (60)

R = tert.$C_4H_9$ R' = —O(—$CH_2CH_2O$)$_4$—$C_2H_5$ (61)

R = $CH_3$ R' = —O(—$CH_2CH_2O$)$_3$—$CH_3$ (62)

Mixtures of a plurality of compounds of the formula I are frequently obtained in the preparation of these compounds. For example, the monoester can be formed in addition to the diester in the esterification of a diol. Polyalkylene glycols are frequently technical mixtures of varying degrees of oxyalkylation. When these are used as the diols, corresponding mixtures of compounds of the formula I are obtained. Such mixtures are equally suitable for the use according to the invention as homogeneous compounds. Since such mixtures are in most cases liquid, they can even be of particular advantage.

Examples of these are the compounds (8), (20), (21), (23), (28), (34), (47) and (51) listed above, or mixtures of (3) and (24), of (19) and (29), of (33) and (46) or of (5), (26), (33) and (46).

Novel compounds and, as such, also the subject of the invention are the compounds of the formula II,

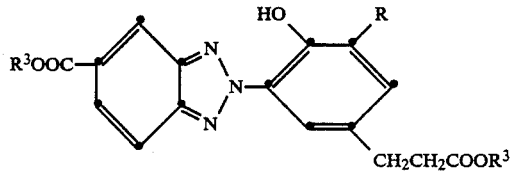

in which R and $R^3$ are as defined above.

As compared with the benzotriazole-type UV absorbers proposed in Research Disclosure No. 24,239, the benzotriazoles used according to the invention are distinguished by an enhanced hydrophilic character. However, it was not to be expected that hydrophilic UV absorbers would be particularly suitable as light stabilizers for ink-jet printing recording materials. As is known, the effect of the UV absorbers is based on the fact that short-wave light (200–400 nm) is filtered out, and this effect should depend only on the wavelengths region of the light absorption of the molecule, but be independent of other properties of the molecule. To this extent, the high effectiveness of the UV absorbers according to the invention was surprising.

Moreover, the compounds of the formula I are readily dispersible. In combination with suitable surfactants, they give very stable oil-in-water emulsions of very small droplet diameter. It has also been found that such emulsions according to the invention do not agglomerate on drying out, so that the UV absorber is in a very homogeneous distribution on the recording material, whereas corresponding emulsions or dispersions containing the UV absorbers indicated in Research Disclosure No. 24,239 tend to an agglomeration of the UV absorber on drying out.

The recording material is a two-dimensional sheet-like structure which can consist of one or more layers. The carrier layer usually consists of paper or a plastic film or of a laminate of such materials. The carrier layer can be coated, on one side or on both sides, with a material which is particularly receptive for the ink dyes. The recording material can be transparent, for example in the case of projection films. In most cases, however, the recording material is not transparent and is read in reflected light.

The UV absorber according to the invention can be incorporated in the carrier material as early as the production of the latter, for example during the production of paper by addition to the paper pulp, or during the production of plastic films by addition to the polymer before extrusion. A second application method is spraying of the carrier material with a solution of the UV absorber in a highly volatile solvent.

In most cases, however, a layer having an affinity for dyes is applied to the carrier material and, in this case, the UV absorbers according to the invention are added to the coating composition. These coating compositions usually consist of a solid filler and a binder as well as minor proportions of additives.

The filler is quantitatively the main constitutent of the coating composition. Examples of conventional fillers are lime, chalk, silica, kaolin, talc, clay, Ca, Mg or Al silicates, gypsum, barite, zeolite, bentonite, diatomaceous earth, vermiculite, titanium dioxide, zinc oxide, magnesium oxide, magnesium carbonate, starch or the surface-modified silica described in JP-A No. 85/260,377.

The binder binds the filler within itself and to the carrier material. It can be used as an aqueous solution, organic solution or aqueous dispersion. Examples of usual binders are polyvinyl alcohol, partially hydrolysed polyvinyl acetate, cellulose ethers, polyvinylpyrrolidone and copolymers thereof, polyethylene oxide, salts of polyacrylic acid, sodium alginate, oxidized starch, gelatine, casein, vegetable gum, dextrin, albumin, dispersions of polyacrylates or acrylate/methacrylate copolymers, latices of natural or synthetic rubber, poly(meth)acrylamide, polyvinyl ethers, polyvinyl esters, copolymers of maleic acid, melamine resins, urea resins, or chemically modified polyvinyl alcohols, as described in JP-A No. 86/134,290 or 86/134,291.

A dye receptor or mordant, which fixes the dye more firmly to the coating, can be added to the binder. Dye receptors for acid dyes are of cationic or amphoteric nature. Examples of cationic receptors are polymeric ammonium compounds, for example polyvinylbenzyltrimethylammonium chloride, polydiallyl-dimethylammonium chloride, polymethacryloxyethyl-dimethylhydroxyethylammonium chloride, polyvinylbenzylmethylimidazolium chloride, polyvinylbenzyl-picolinium chloride or polyvinylbenzyl-tributylammonium chloride. Further examples are basic polymers, such as poly(dimethylaminoethyl methacrylate), polyalkylenepolyamines and condensation products thereof with dicyandiamide, amine/epichlorohydrin polycondensates or the compounds described in JP-A No. 82/36,692, 82/64,591, 82/187,289, 82/191,084, 83/177,390, 83/208,357, 84/20,696, 84/33,176, 84/96,987, 84/198,188, 85/49,990, 85/71,796, 85/72,785, 85/161,188, 85/187,582, 85/189,481, 85/189,482, 86/14,979, 86/43,593, 86/57,379, 86/57,380, 86/58,788, 86/61,887, 86/63,477, 86/72,581, 86/95,977 and 86/134,291 or in U.S. Pat. Nos. 4,547,405 and 4,554,181 and also in DE-A-3,417,582. Gelatine is an example of amphoteric dye receptors.

The dye-binding coating can contain a number of further additives, for example antioxidants, light stabilizers (also including UV absorbers which are not UV absorbers according to the invention), viscosity improvers, fluorescent brighteners, biocides or/and antistatics.

Examples of suitable antioxidants are, in particular, sterically hindered phenols and hydroquinones, for example the antioxidants listed in GB-A No. 2,088,777 or in JP-A Nos. 85/72,785, 85/72,786 and 85/71,796.

Examples of suitable light stabilizers are, in particular, organic nickel compounds and sterically hindered amines, for example the light stabilizers mentioned in JP-A Nos. 83/152,072, 86/146,591, 86/163,886, 85/72,785 and 86/146,591 or in GB-A No. 2,088,777, JP-A Nos. 084/169,883 and 86/177,279.

If the UV absorber used according to the invention is a liquid, these additives can be dissolved directly in the UV absorber. Alternatively, they are dissolved in an organic solvent and mixed with the liquid UV absorber or with a solution of the UV absorber in an organic solvent.

Preferably, aqueous coating compounds are used. In this case, the UV absorber and the other additives must be dispersed as homogeneously as possible in the coating composition. If the UV absorber is liquid, it can, after the addition of surfactants, be dispersed directly in the binder or in the coating composition. If the UV absorber is solid or viscous, it is advisable to dissolve it in an organic solvent and to disperse this solution in the coating composition.

The solvent used is preferably of low volatility, so that the UV absorber remains in the liquid state even after prolonged storage of the recording material. For preparing the dispersions, however, a volatile auxiliary solvent is also added in most cases, and this is removed again during the process of producing the recording material. Examples of low-volatility solvents are organic liquids of oily character and high boiling point, for example phthalates (e.g. dimethyl, diethyl, dibutyl, diamyl, dihexyl, diheptyl, dioctyl, dinonyl or didecyl phthalate, or dibutyl chlorophthalate), glycollates (for example butylphthalyl-butyl glycolate), phenols (for example 2,4-di-n-amylphenol or 2,4-di-tert-amylphenol), phosphates (for example diphenyl, triphenyl, tricresyl, cresyl diphenyl, dioctyl, dioctyl butyl, trioctyl, tridecyl, trixylenyl, tri-(isopropylphenyl), tributyl, trihexyl, trinonyl, trioleyl or tri-(butoxyethyl) phosphates), citrates (for example triethyl, tributyl, trihexyl, trioctyl, trinonyl or tridecyl O-acetyl-citrates), benzoates (for example butyl, hexyl, heptyl, octyl, nonyl, decyl, undecyl, dodecyl, tetradecyl, octadecyl or oleyl benzoates), esters of substituted benzoic acids (for example butyl 2-methoxybenzoate, pentyl o-methylbenzoate, decyl p-methylbenzoate, lauryl o-chlorobenzoate, propyl 2,4-dichlorobenzoate, oleyl 2,4-dichlorobenzoate or octyl p-methoxybenzoate), fatty acid esters and dicarboxylic acid esters (for example hexadecyl myristate, dibutyl sebacate, dibutoxyethyl succinate, dioctyl adipate, dioctyl azelate and benzyl caprylate), esters of polyols (for example decamethylene glycol diacetate, triacetylglycerol or tributyroylglycerol, pentaerythritol tetracapronate or isosorbitol dicaprylate), fatty acid amides (for example N,N-dimethyl-, N,N-diethyl- or N,N-dibutyl-laurylamide), chlorinated paraffins, aliphatic or aliphatic-aromatic ethers (for example glycerol trialkyl ethers, glycerol 1,3-dialkyl ethers, n-pentadecyl phenyl ether or 3-pentadecylphenyl ethyl ether), alkyl arylcarbamates (for example ethyl N,N-diphenylcarbamate) or mixtures of such liquids.

The volatile solvents used can be liquids which boil no higher than 150° C. Examples of these are lower alkyl acetates or propionates (for example methyl, ethyl, n-propyl, isopropyl or butyl acetate, or methyl or ethyl propionate), ethyl formate, diethyl carbonate, lower chloroalkanes (for example carbon tetrachloride, di- and tri-chloroethylene, 1,2-dichloropropane, chloroform or amyl chloride), ketones (for example acetone, methyl ethyl ketone, diethyl ketone or methyl isobutyl ketone), ethers (for example diisopropyl ether, dibutyl ether, tetrahydrofuran or dioxane), alcohols (for example methanol, ethanol, isoopropanol or butanol), monoethers of diols (for example ethylene glycol monomethyl ether or monoethyl ether), hydrocarbons (for example cyclohexane, methylcyclohexane, petroleum ether, benzene, toluene or xylene), nitromethane, acetonitrile, dimethyl sulfoxide, N-methylpyrrolidone, dimethylformamide, tetrahydrothiophene dioxide, butyrolactone or 1,2-dimethoxyethane.

These auxiliary solvents serve to achieve improved dispersion of the UV absorber or its solution in a high-boiling solvent. If, however, the UV absorber is a liquid of low viscosity, which is readily dispersible due to its polar or hydrophilic character, no solvent is necessary, and this applies in the case of many of the UV absorbers used according to the invention. As a result, the preparation of the emulsions can be simplified, and recovery of the auxiliary solvent is no longer necessary.

If an auxiliary solvent is used, this must be removed again before the coating step. This can be effected by heating and/or vacuum treatment, for example in a vacuum-spray evaporator or in a rotary vacuum evaporator.

If the binder of the coating composition is an aqueous solution, a dispersion or a latex, the oily phase of the UV absorber or its solution in the aqueous phase must be dispersed homogeneously, and this dispersion should have the longest possible pot life, during which the dispersed oil droplets do not increase in size or the dispersion does not segregate. This can be achieved—apart from the use of solvents—by the use of surfactants, by the addition of colloids to the aqueous phase or by means of appropriately intensive mixing and dispersing machines.

Examples of suitable dispersing machines are ultrasonic appliances, turbine stirrers, homogenizers, colloid mills, bead mills, sand mills or high-speed stirrers.

Examples of colloids, which are added to the aqueous phase and which stabilize the resulting dispersions, are polyvinyl alcohol, cellulose ethers, polyethylene oxide, salts of polyacrylic acid, gelatine, vegetable gum, dextrin, casein or albumin. These colloids are at the same time also binders.

Examples of surface-active dispersing aids can be nonionic, amphoteric, anionic or cationic surfactants. Examples of nonionic surfactants are esters or ethers of polyethylene oxides or polypropylene oxides or of copolymers thereof, fatty acid alkanolamides, ethoxylated alkanolamides, partial fatty acid esters of polyols (for example of glycerol, polyglycerol, sorbitol, pentaerythritol or sucrose), N-alkylmorpholines or long-chain amine oxides.

Examples of amphoteric surfactants are fatty acid amidoalkyl-betaines, fatty acid amidoalkyl-sultaines, fatty acid imidazoline-betaines, N-alkyl-$\beta$-aminopropionic acids or alkylene bis-(amidoalkylglycinates).

Examples of anionic surfactants are alkali metal salts or ammonium salts of fatty acids, of alkyl sulfates, of amido-ethylene oxidesulfates, of alkylsulfonic or alkylarylsulfonic acids, of N-alkyl-taurines and N-acyl-taurines, of fatty acid isethionates, of alkyl-sulfosuccinates, of lignin-sulfonates, of petroleum-sulfonates, of monoalkyl or dialkyl phosphates, of N-alkylsarcosines, of alkylsulfonamidoacetic acids, of alkyl lactates, of monoalkyl succinates, of fatty acid/protein condensation products, of (alkyl)naphthenic acids, of abietic acids, of sulfonated fatty acids or of N-acyl-aminocarboxylic acids.

Examples of cationic surfactants are the quaternary ammonium salts of long-chain fatty amines and benzylamines, imidazolinium, pyridinium, picolinium, or morpholinium salts having long-chain alkyl radicals, quaternary ammonium salts of long-chain alkylamidoalkylamines or bis-ammonium salts of quaternary diamines.

The surfactant can be dissolved beforehand in the oil phase or in the water phase, or in both phases. It is also possible to add different surfactants to the two phases, but these must not have contradictory activity (cationic/anionic).

In the case of using cationic surfactants, destruction of the oil-in-water dispersion can arise on addition of the filler, if the surface of the filler carries an electronegative charge, as is the case, for example, with silica. This problem can be solved by pretreating the surface of the filler. For this purpose, silanes carrying functional groups are used in most cases; these appropriately modify the electric charge on the surface, an example being 3-(trimethoxysilyl)-propyldimethyl-octadecyl-ammonium chloride.

Where a polyvinyl alcohol is used as the binder and colloid for the coating composition, particularly the following surfactants have proved especially suitable as dispersing aids for the oily phase containing the UV absorber: diisobutylphenoxyethyl-dimethyl-benzyl-ammonium chloride, didecyl-dimethyl-ammonium chloride, tallow fat-ammonium acetate, oleyl-dimethyl-benzyl-ammonium chloride and alkylarylsulfonates.

The effect of the alkylarylsulfonates can be further enhanced by an addition of wetting agents, which likewise are surfactants. Examples of these are sodium dioctylsulfosuccinate and alkylnaphthalenesulfonates.

If the binder is applied as a solution in an organic solvent to the coating composition, the UV absorber and the other additives do not need to be dispersed. They are then added directly to the binder solution, or they are dissolved beforehand in an organic solvent.

The coating composition is applied to the carrier, which in most cases is a paper, and dried by heating. The recording material prepared in this way contains preferably 1 to 5,000 mg/m$^2$, especially 200–1,200 mg/m$^2$, of the UV absorber.

The recording material thus prepared, which contains at least one of the UV absorbers according to the invention in its surface layer and can contain the other additives mentioned, is also a subject of the invention. This recording material has not only a good absorption capacity for ink jet dyes, but also imparts high light fastness to the imprinted dye. The nature of the ink and of the dye dissolved therein and the type of printing device (printer) used are immaterial here.

In the case of the printers used nowadays, a distinction is made between those having a continuous ink jet and an intermittent ink jet. There are also drop-on-demand printers, bubble-jet printers, compound-jet printers or ion beam printers. The recording material according to the invention can be used for all these types of process equipment.

The inks are in most cases aqueous inks, but they can also be solutions of the dye in an organic solvent or in a molten wax. In most cases, aqueous inks also contain water-soluble solvents, for example monoethylene, diethylene, triethylene or higher ethylene glycols, propylene glycol, 1,4-butanediol or ethers of such glycols, thiodiglycol, glycerol and its ethers and esters, polyglycerol, mono-, di- and tri-ethanolamine, propanolamine, dimethylformamide, dimethyl sulfoxide, dimethylacetamine, N-methylpyrrolidone, 1,3-dimethylimidazolidone, methanol, ethanol, isopropanol, n-propanol, diacetone-alcohol, acetone, methyl ethyl ketone or propylene carbonate.

Aqueous inks contain water-soluble dyes, such as are also known for the dyeing of natural fibres. This can be, for example, monoazo dyes, disazo dyes or polyazo dyes, or phthalocyanine dyes. Examples of these are Food Black 2, C.I. Direct Black 19, C.I. Sulfur Black 1, Acid Red 35, Acid Yellow 23 or copper phthalocyanines.

Aqueous inks can also contain minor quantities of various additives, for example binders, surfactants, biocides, corrosion inhibitors, chealating agents, pH buffers or conductivity additives. They can also contain water-soluble UV absorbers or other water-soluble light stabilizers. In general, however, the addition, according to the invention, of a UV absorber to the recording material suffices.

If the ink is a non-aqueous ink, it represents a solution of the dye in an organic solvent or solvent mixture or in a molten wax. Examples of solvents used for this purpose are alkylcarbitoles, alkylcellosolves, dialkylformamides, dialkylacetamides, alcohols, especially alcohols having 1–4 C atoms, acetone, methyl ethyl ketone, diethyl ketone, methyl isobutyl ketone, diisopropyl ketone, dibutyl ketone, dioxane, ethyl butyrate, ethyl isovalerate, diethyl malonate, diethyl succinate, methyl perlargonate, butyl acetate, triethyl phosphate, ethylglycol acetate, toluene, xylene, tetralin and petroleum spirit fractions. Examples of solid waxes as solvents are stearic acid or palmitic acid.

Such solvent-based inks contain dyes soluble therein, for example Solvent Red, Solvent Yellow, Solvent Orange, Solvent Blue, Solvent Green, Solvent Violet, Solvent Brown or Solvent Black. Such inks can also contain yet further additives, such as are listed above for aqueous inks.

The examples which follow illustrate the preparation of a coating composition used according to the invention and of the recording material obtained therefrom. They also illustrate the stabilizing effect of the addition of the UV absorber. Percentage data relate to the weight, unless otherwise stated.

EXAMPLE

Coating compositions are prepared which are based on silica/polyvinyl alcohol and contain a dispersion of a UV absorber, with and without an addition of tricresyl phosphate as an oil phase. In the case of the additional use of tricresyl phosphate (TCP), this is added in a UV absorber:TCP weight ratio of 2:1. The dispersant used is the following solution of two anionic surfactants:

10 g of phenylsulfonate HSR paste (65%), Hoechst AG, 1.3 g of Nekal® BX paste (62.5%), BASF AG, and 13.7 g of water.

1.6 g of surfactant solution are used per g of UV absorber and TCP.

The UV absorber and, if appropriate, the TCP are dissolved in a little ethyl acetate. A solution of 3.27 g of polyvinyl alcohol (PVA) in 68 g of water is mixed with the surfactant solution, and this mixture is mixed with the ethyl acetate solution of the UV absorber, using a magnetic stirrer. The mixing ratios can be seen from Table 1.

The ethyl acetate is removed at 45° C. in a rotary evaporator, a homogeneous dispersion of the oily phase in the PVA solution being formed. 4.0 g of silica (type 244, Grace & Co) are added in each case to 3.27 g of PVA, and the dispersion is ultrasonically homogenized for 30 seconds. The resulting coating composition is filtered through a polyester fibre screen of 24 μm mesh width, and the pH is adjusted to 7.0 by the addition of 2N sodium hydroxide solution. The coating composition (without UV absorber) contains 9.7% of solids.

TABLE 1

| Sample No. | UV absorber | Quantities used per 3.27 g of PVA and 4.0 g of silica: UV absorber | TCP | Surfactant solution | Ethyl acetate |
|---|---|---|---|---|---|
| 1 | none | — | — | 0.10 g | |
| 2 | A-1 | 0.81 g | — | 1.30 g | — |
| 3 | A-1 | 0.81 g | — | 1.30 g | 5 g |
| 4 | A-2 | 0.75 g | — | 1.20 g | 5 g |
| 5 | A-3 | 0.60 g | — | 0.96 g | 5 g |
| 6 | A-3 | 0.60 g | 0.30 g | 1.44 g | 5 g |
| 7 | A-4 | 0.80 g | — | 1.29 g | 5 g |

The following UV absorbers are used:

A-1 mixture of about 57% of

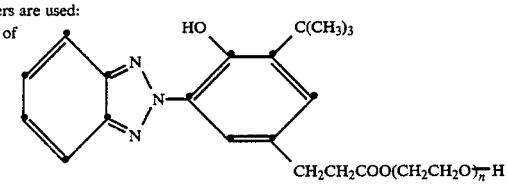

and about 43% of

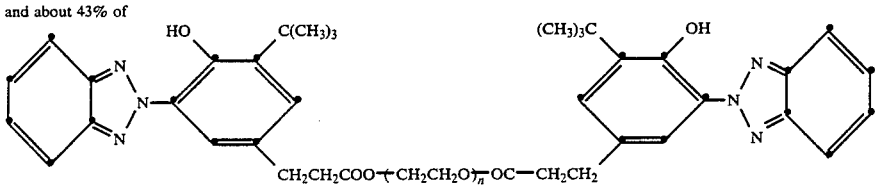

n~6

A-2

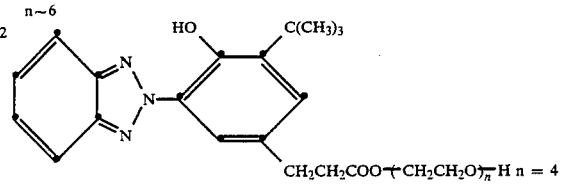

A-3

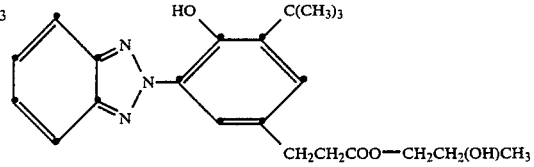

A-4

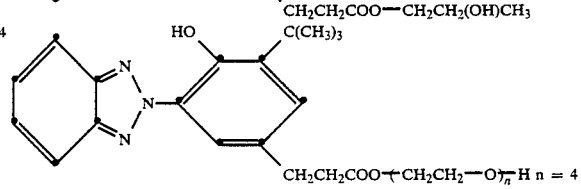

The coating compositions are applied in a thickness of 50 μm by means of a wire-wound draw bar to photographic paper. The coating obtained after warm-air drying is about 5 g/m$^2$ and contains 1 mmol of UV absorber per m$^2$.

The recording material thus prepared is printed with a yellow ink and a red ink in an ink-jet printing device. The yellow ink is prepared from 5 parts of Acid Yellow 23,
50 parts of diethylene glycol and
45 parts of water.

The red ink is prepared analogously, using Acid Red 35. The inks are filtered through an ultrafilter of 0.3 μm pore width and filled into the ink cartridges of the "Think Jet" (Hewlett-Packard). Proofs are prepared at a dot density of 75 dots per cm.

The colour density (intensity) of the stained areas is determined by means of a densitometer (Macbeth TR 924), using a status A filter. The proofs are then irradiated in an Atlas weatherometer with a xenon lamp of 81 klux illumination behind a window glass filter. The colour density is then measured again. The percentage colour density loss during the irradiation is given in Table 2.

TABLE 2

| Sample No. | UV Absorber | Colour density loss in % after irradiation of Yellow ink 15 kJ/cm$^2$* | Red ink 5 kJ/cm$^2$* |
|---|---|---|---|
| 1 | none | 53 | 71 |
| 2 | A-1 | 43 | 53 |
| 3 | A-1 | 46 | 53 |
| 4 | A-2 | 38 | 38 |
| 5 | A-3 | 43 | 48 |
| 6 | A-3/TCP | 40 | 37 |
| 7 | A-4 | 35 | 35 |

*Measured amount of radiation energy in the 300–800 nm range.

What is claimed is:

1. An ink jet recording process wherein a recording material is stabilized against light-induced damage, comprising, (a) providing a sheet of recording material having a printable surface and containing an effective stabilizing amount of at least one compound of formula (I)

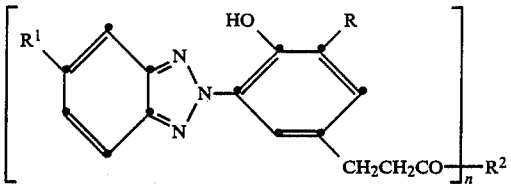

(I)

in which n is 1 or 2, R is hydrogen, $C_1$–$C_{12}$-alkyl, $C_5$–$C_8$-cycloalkyl, phenyl or $C_7$–$C_9$-phenylalkyl, R′ is hydrogen, chlorine or methoxy, and $R^2$, when n is 1, is a group of the formula $$-O-(CH_2CH_2O)_u-H,\ -O-(CH_2\underset{\underset{CH_3}{|}}{C}H-O)_v-H \text{ or}$$

$$-O-(CH_2\underset{\underset{OH}{|}}{C}H-CH_2-O)_w-H,$$

in which u is 1–9, v is 1–6 and w is 1–6, or $R^2$, when n is 2, is a group of the formula $$-O-(CH_2CH_2O)_x- \text{ or } -O-(CH_2\underset{\underset{CH_3}{|}}{C}H-O)_y-,$$

in which x is 1–7 and y is 1–4, and (b) imagewise applying an ink jet recording ink to said recording material.

2. A process according to claim 1, wherein the recording material is a coated paper.

3. A process according to claim 1, where in the compound of formula I, R is $C_1$–$C_4$-alkyl.

4. A process according to claim 1, where in the compound of formula I, R is tert-butyl.

5. A process according to claim 1, wherein the compound of formula I is liquid at room temperature.

6. A process according to claim 1, wherein the printable surface is impregnated with a cationic dye acceptor in addition to a compound of formula I.

7. A process according to claim 1, wherein the printable surface is impregnated with a compound selected from the group consisting of the antioxidants, fluorescent brighteners, biocides, further light stabilizers and mixtures thereof, in addition to a compound of formula I.

* * * * *